US009622541B2

(12) United States Patent
Yang

(10) Patent No.: US 9,622,541 B2
(45) Date of Patent: Apr. 18, 2017

(54) ANTISKID-STYLE SOLE

(76) Inventor: Menglong Yang, Shenzhen (CN)

( * ) Notice: Subject to any disclaimer, the term of this patent is extended or adjusted under 35 U.S.C. 154(b) by 1064 days.

(21) Appl. No.: 13/639,239

(22) PCT Filed: Nov. 8, 2010

(86) PCT No.: PCT/CN2010/078504

§ 371 (c)(1),
(2), (4) Date: Oct. 4, 2012

(87) PCT Pub. No.: WO2011/054317

PCT Pub. Date: May 12, 2011

(65) Prior Publication Data

US 2013/0042504 A1 Feb. 21, 2013

(30) Foreign Application Priority Data

Nov. 9, 2009 (CN) ..... 2009 1 0110043

(51) Int. Cl.

| | |
|---|---|
| ***A43C 15/00*** | (2006.01) |
| ***A43B 5/00*** | (2006.01) |
| ***A43B 23/28*** | (2006.01) |
| ***A43B 13/22*** | (2006.01) |

(52) U.S. Cl.

CPC ..... *A43B 13/223* (2013.01)

(58) Field of Classification Search

CPC ... A43B 13/223; A43B 13/122; A43B 13/145; A43B 13/146; A43B 13/148

USPC ..... 39/59 C, 59 D, 67 A–67 B, 59 R, 8.3; 36/59 C, 59 D, 67 A–67 B, 59 R, 8.3; D2/957

See application file for complete search history.

(56) References Cited

U.S. PATENT DOCUMENTS

| | | | | |
|---|---|---|---|---|
| 4,375,728 | A * | 3/1983 | Dassler | A43B 13/223 36/114 |
| 7,146,752 | B2 * | 12/2006 | Pasternak | 36/59 R |
| 7,287,343 | B2 * | 10/2007 | Healy | A43B 13/223 36/134 |
| D597,735 | S * | 8/2009 | Norton | D2/957 |
| 8,991,076 | B2 * | 3/2015 | Kasprzak | 36/127 |
| 2002/0078598 | A1 * | 6/2002 | Bell | 36/59 R |
| 2011/0247237 | A1 * | 10/2011 | Jara et al. | 36/103 |

* cited by examiner

*Primary Examiner* — Anna Kinsaul
*Assistant Examiner* — Timothy K Trieu
(74) *Attorney, Agent, or Firm* — Novoclaims Patent Services LLC; Mei Lin Wong

(57) ABSTRACT

An antiskid-style sole includes a sole body (1) and a number of projections (2) disposed on the sole body (1). The projections (2) are elastic columnar parts. A cavity (22) is disposed in the middle of end surface (23) of the projection (2), and the wall of the cavity (22) is in the shape of cambered surface or inclined surface.

15 Claims, 3 Drawing Sheets

ANTISKID-STYLE SOLE

BACKGROUND OF THE PRESENT INVENTION

Field of Invention

The present invention relates to a sole for footwear, and more particularly to a slip-resistant sole which is slip-resistant on a smooth surface.

Description of Related Arts

With the economic development, more and more building structures or construction structures are constructed with floor materials which have better leveling capability. For examples, common floor materials include marbles, ceramic floor tiles and etc. Because the floor using these materials is better leveled and smooth, the coefficient of fiction is small. When people wearing regular shoes walk on the floor constructed with these materials, he or she will easily slip and fall. Accordingly, slip-resistant shoes are emerged.

In general, conventional anti-slip shoes include shoe soles with a plurality of groves laterally and longitudinally intercrossing with each other such that a plurality of small protrusions in the bottom end of the sole are formed. The protrusions are usually flat. Though this type of shoes can provide anti-slip function, the anti-slip ability is not good.

SUMMARY OF THE PRESENT INVENTION

An object of the present invention is to provide a slip-resistant sole which has improved slip resistance.

Additional advantages and features of the invention will become apparent from the description which follows, and may be realized by means of the instrumentalities and combinations particular point out in the appended claims.

According to the present invention, the foregoing and other objects and advantages are attained by a slip-resistant sole which comprises a bottom sole and a plurality of protruded units outwardly extended from the bottom sole, wherein each of the protruded unit is resilient and has a columnar structure defining a bottom end and a protruded unit cavity, wherein the protruded unit cavity is provided at the middle portion of the protruded unit in the bottom end and a side wall of the protruded unit cavity is defined, wherein the side wall of the protruded unit cavity has a curved or inclined cross-section.

Preferably, the protruded unit has at least one guiding groove in the bottom end and each the guiding groove is channeled to the protruded unit cavity.

Preferably, a junction groove is peripherally provided to the protruded unit and is positioned between a connecting junction between the protruded unit and the bottom sole.

Preferably, a cross-section of the protruded unit is trapezium in shape defining a long side and a short side, wherein the protruded unit is connected to the bottom sole through the short side of the protruded unit.

Preferably, an angle is defined between an outer side of the protruded unit and the bottom sole, wherein the angle is between 60° and 90°.

Preferably, the bottom end has a round-shape, a rectangular-shape or a square-shape construction.

According to the preferred embodiment of the present invention, the slip-resistant sole comprises a bottom sole and a plurality of protruded units outwardly extended from the bottom sole, wherein each of the protruded unit is resilient and has a columnar structure defining a bottom end and a protruded unit cavity, wherein the protruded unit cavity is provided at the middle portion of the protruded unit in the bottom end and a side wall of the protruded unit cavity is defined, wherein the side wall of the protruded unit cavity has a curved or inclined cross-section. Compared to conventional art, the bottom sole according to the preferred embodiment of the present invention has a protruded unit with a protruded unit cavity in which a height of the protruded unit will be decreased and the protruded unit will be deformed outwardly when a force is acted onto the bottom sole such that an adsorption force is constructed through a supporting and sucking relationship between the bottom end of the bottom sole and floor surface, thereby a friction between the bottom sole and the floor surface is increased. In addition, when the slip-resistant sole is used in wet smooth floor surface with water or oil, the deformed protruded unit can cause the water or the oil to be quickly removed through the gap between two adjacently positioned protruded unit while the guiding groove in the bottom end of the protruded unit can direct the water or the oil in the protruded unit cavity to flow outside of the protruded unit, therefore further increasing the anti-slip function.

Still further objects and advantages will become apparent from a consideration of the ensuing description and drawings.

These and other objectives, features, and advantages of the present invention will become apparent from the following detailed description, the accompanying drawings, and the appended claims.

The structures, features, and advantages of the slip-resistant sole according to the preferred embodiment of the present invention is further described with the accompanying drawings as follows.

DETAILED DESCRIPTION OF THE PREFERRED EMBODIMENT

Figure 1:
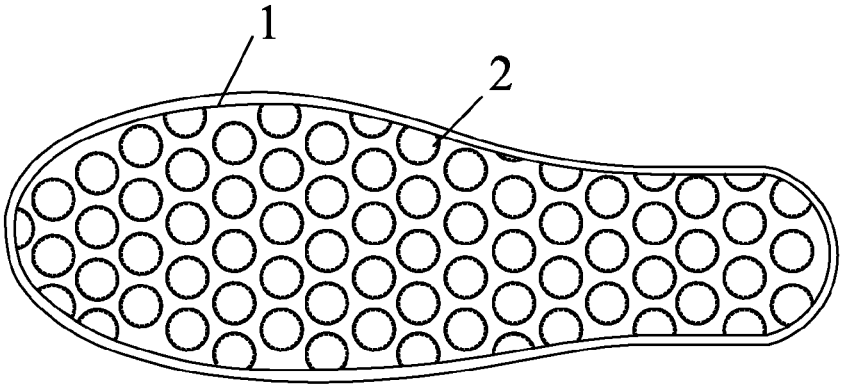
FIG. 1 is a structural illustration of a slip-resistant sole according to a preferred embodiment of the present invention.
Figure 2:
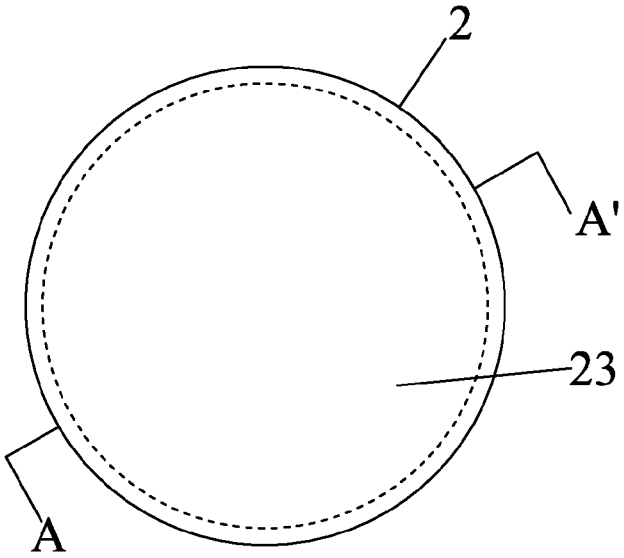
FIG. 2 is an illustration of a protruded unit of the slip-resistant sole according to the above preferred embodiment of the present invention.
Figure 3:
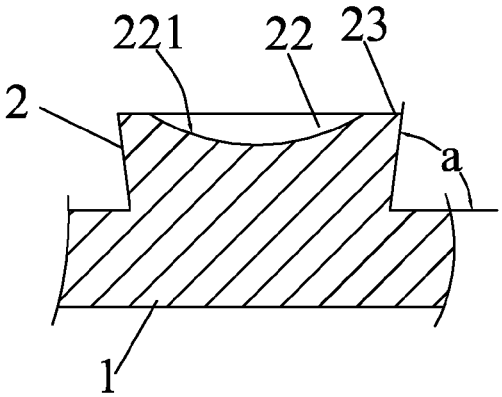
FIG. 3 is an A-A' cross-sectional illustration of a protruded unit of the slip-resistant sole according to the above preferred embodiment of the present invention.

Referring to FIGS. 1, 2 and 3 of the drawings, the slip-resistant sole according to the preferred embodiment of the present invention is illustrated.

According to the preferred embodiment of the present invention, the slip-resistant sole comprises a bottom sole 1 and a plurality of protruded units 2 outwardly extended from and spacedly positioned on the bottom sole 1. The protruded unit 2 is resilient and has a columnar structure. The protruded unit 2 has a bottom end 23 and a protruded unit cavity 22 provided at the middle portion of the protruded unit 2 in the bottom end 23. A side wall of the protruded unit cavity 22 has a curved or inclined cross-section. The provision of the protruded unit cavity 22 not only facilitate the protruded unit to deform flexibly and easily, but also creating an adsorption force through a supporting and sucking relationship with a floor surface, thereby enhancing the slip-resistant ability.

The position of the protruded unit cavity 22 with curved or inclined side wall 221 can be designed or arranged based on different needs of a user. For example, the edge of an opening of the protruded unit cavity 22 is overlapped with the edge of the bottom end 23 of the protruded unit 2, or is at a distance from the edge of the bottom end 23 of the protruded unit 2.

A cross-section of the protruded unit 2 is trapezium in shape defining a long side and a short side. The protruded unit is extended from the bottom sole through the short side of the protruded unit 2. An angle "a" is defined between an outer side of the protruded unit 2 and the bottom sole 1, wherein the angle is between 60° and 90°.

Because the cross-section of the protruded unit is trapezium in shape while the connecting portion between the protruded unit 2 and the bottom sole 1 has a surface area smaller than a surface area of the bottom end 23 of the protruded unit 2, the protruded unit will be deformed outwardly when a force is acted onto the bottom sole and a height of the protruded unit 2 will be decreased. Accordingly, a contacting area between the floor surface and the protruded unit 2 is increased, thereby increasing a friction between the bottom sole and the floor surface. In addition, a gap is provided between each of the protruded units 2. Accordingly, when the slip-resistant sole is used in wet smooth floor surface with water or oil, a weight of a user will cause the protruded units 2 on the bottom sole 1 to deform, thereby causing the water or the oil to be quickly removed through the gap between two adjacently positioned protruded units 2, thereby further increasing the slip-resistant ability.

Figure 4:
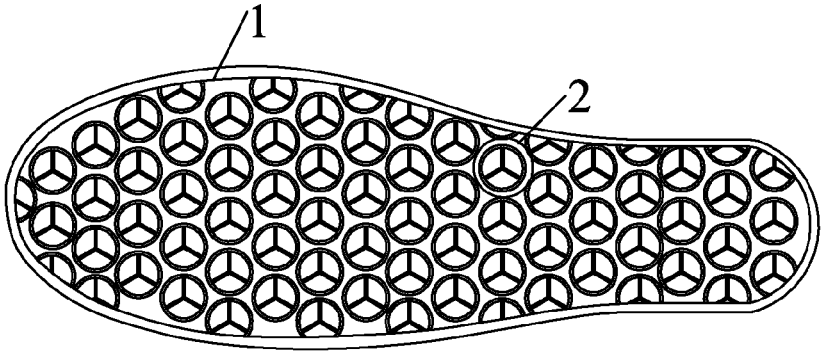
FIG. 4 is a structural illustration of a slip-resistant sole of a first alternative embodiment according to the preferred embodiment of the present invention.
Figure 5:
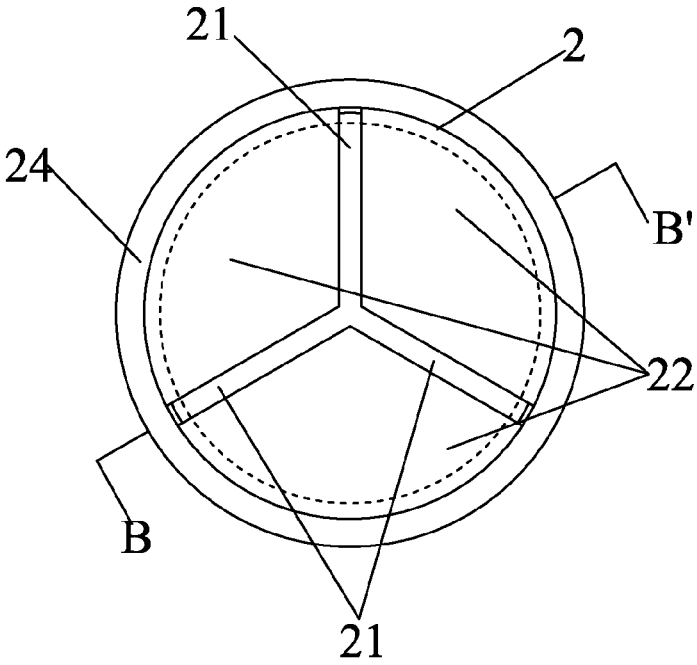
FIG. 5 is an illustration of a protruded unit of the slip-resistant sole of the first alternative embodiment according to the above preferred embodiment of the present invention.
Figure 6:
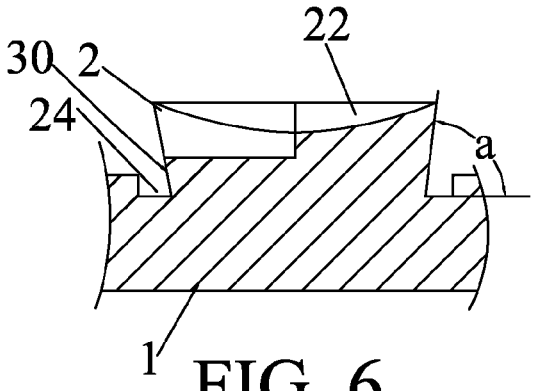
FIG. 6 is a B-B' cross-sectional illustration of a protruded unit of the slip-resistant sole of the first alternative embodiment according to the above preferred embodiment of the present invention.

Referring to FIGS. 4, 5 and 6 of the drawings, another structural construction is provided based on the above preferred embodiment of the present invention. In particular, at least one guiding groove 21 is provided on the bottom end 23 of the protruded unit 21 and the guiding groove 21 is positioned uniformly on the bottom end 23. The guiding groove 21 is channeled to the protruded unit cavity 22 through a distal end of the guiding groove 21.

When the slip-resistant sole is used in wet smooth floor surface with water or oil, the guiding groove 21 can direct a small amount of water or oil to flow from the protruded unit cavity 22 to outside of the protruded unit 2, thereby increasing a coefficient of friction between the bottom sole and the floor surface and increasing the slip-resistant ability of the slip-resistant sole of the present invention. On the other hand, the protruded unit 2 is pressed to deform, therefore creating a force at three different directions on the bottom end 23 of which the force at each direction is equal, thereby the protruded unit 2 is supported through the force at three different directions. At the same time, the protruded unit cavity 22 and the floor surface have created an absorption force through their supporting and sucking relationship, thereby a coefficient of friction between the bottom sole 1 and the floor surface is increased and the slip-resistant ability of the sole is further increased.

The number of the guiding groove as mentioned above can be uniformly provided on the curved surface according to the design need. For example, the number of guiding groove can be 1, 2 or more. When the number of guiding groove is two or more, the guiding grooves are spacedly provided on the bottom end 22 and a distal end of each guiding groove is channeled to the protruded unit cavity 22 respectively.

According to the above embodiment, a junction groove 24 is further provided and is positioned at a connecting junction 30 between the protruded unit 2 and the bottom sole 1. The connecting junction 30 is the junction at which the protruded unit 2 and the bottom sole 1 are connected. The junction groove 24 is not only capable of increasing a height of the protruded unit 2, but also increasing the softness of the protruded unit 2. In addition, when the bottom sole 1 is being acted by force from different directions, the resilient protruded unit 2 can absorb a portion of the energy and therefore the slip-resistant ability of the bottom sole 1 is enhanced.

The protruded unit 2 can be made by resilient materials such as rubber and PU. The number of protruded unit 2 on the bottom sole 1 can also be adjusted according to the design need. When the number of protruded unit 2 is increased, the slip-resistant ability is increased.

Figure 7:
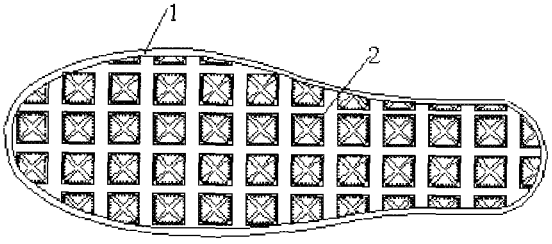
FIG. 7 is a structural illustration of a slip-resistant sole of a second alternative embodiment according to the preferred embodiment of the present invention.
Figure 8:
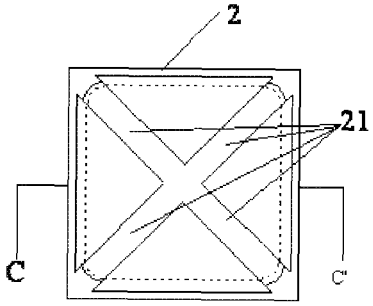
FIG. 8 is an illustration of a protruded unit of the slip-resistant sole of the second alternative embodiment according to the above preferred embodiment of the present invention.
Figure 9:
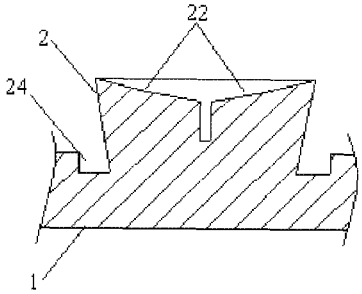
FIG. 9 is a C-C' cross-sectional illustration of a protruded unit of the slip-resistant sole of the second alternative embodiment according to the above preferred embodiment of the present invention.

Referring to FIGS. 7, 8 and 9 of the drawings, the bottom end of the protruded unit 2 can be rectangular or square shape in which four guiding groove 21 is provided in the bottom end of the protruded unit 2. The four guiding grooves 21 divide the bottom end into four sections. When the protruded unit is pressed to deform, equal forces are created through the bottom end 23 at four opposite directions. Therefore the protruded unit 2 is supported by the force at four directions and hence the bottom sole 1 is provided with slip-resistant ability.

When the number of guiding groove is one, the bottom end of the protruded unit 2 is divided into two symmetrical portions. When the bottom end is pressed to deform, two equal forces are created from the bottom end 23 at two opposite directions, therefore the protruded unit 2 is supported by the force at two different directions and hence the bottom sole 1 is provided with slip-resistant ability.

The number of guiding groove can be 1, 2 or more. When the number of guiding groove is two or more, the guiding grooves are spacedly provided on the bottom end 23 and a distal end of each guiding groove is channeled to the protruded unit cavity 22 respectively.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A slip-resistant sole, which comprises: a bottom sole; and a plurality of protruded units outwardly extended from said bottom sole, each of said protruded units being resilient and having a columnar structure which defines a bottom end, a continuous and leveled peripheral edge surrounding said bottom end and a protruded unit cavity, said protruded unit cavity being provided at a center portion of said protruded unit on said bottom end of said protruded unit, a side wall of said protruded unit cavity having a curved and inclined cross-sectional shape extending from said continuous peripheral edge towards the center portion of said protruded unit on said bottom end, said protruded units having at least one guiding groove formed on said bottom end extending from said center portion of said protruded unit on said bottom end of said protruded unit to a peripheral portion of said protruded unit on said bottom end of said protruded unit and having an indentation construction for defining a discrete guiding channel from said center portion to said peripheral portion of said protruded unit on said bottom end of said protruded unit, wherein said guiding grooves guides oil-base or water-base liquid to move from said center portion of said protruded unit on said bottom end of said protruded unit towards said peripheral portion of said protruded unit through said discrete guiding channel.

2. The slip-resistant sole, as recited in claim 1, wherein said protruded units has a trapezoidal cross sectional shape which defines a longer side and a shorter side opposing to said longer side, said protruded units being connected to said bottom sole through said shorter side of said protruded unit.

3. The slip-resistant sole, as recited in claim 2, wherein a surface area of each connection junction disposed between said protruded unit and said bottom sole is smaller than a surface area of said bottom end of said protruded unit such that each said resilient and columnar structure of said protruded unit is deformed and compressed to having an increased surface area of said bottom end of said protruded unit through outwardly extending from said peripheral portion of said protruded unit on said bottom end when said bottom sole is pressed against a ground surface, thereby each said guiding groove is capable of guiding liquid movement while said protruded unit is capable of structurally supporting the bottom sole by its increased surface area through deformation to grip firmly onto the ground surface.

4. The slip-resistant sole, as recited in claim 3, wherein an angle of inclination between an outer side of said protruded units and said bottom sole is approximately 75° such that the deformation of said protruded unit is facilitated when said bottom sole is pressed onto the ground surface.

5. The slip-resistant sole, as recited in claim 4, wherein said protruded units has a junction groove peripherally formed around all sides on said protruded unit.

6. The slip-resistant sole, as recited in claim 3, wherein an angle of inclination between an outer side of said protruded units and said bottom sole is approximately 80° such that the deformation of said protruded unit is facilitated when said bottom sole is pressed onto the ground surface.

7. The slip-resistant sole, as recited in claim 6, wherein said protruded units has a junction groove peripherally formed around all sides on said protruded unit.

8. The slip-resistant sole, as recited in claim 7, wherein said bottom end of said protruded units has one of a round-shape, a rectangular shape and a square-shape bottom end surface construction.

9. The slip-resistant sole, as recited in claim 3, wherein said protruded units has a junction groove peripherally formed around all sides on said protruded unit.

10. The slip-resistant sole, as recited in claim 9, wherein said bottom end of said protruded units has one of a round-shape, a rectangular shape and a square-shape bottom end surface construction.

11. The slip-resistant sole, as recited in claim 3, wherein said bottom end of said protruded units has one of a round-shape, a rectangular shape and a square-shape bottom end surface construction.

12. A slip-resistant sole, which comprises: a bottom sole; and a plurality of protruded units outwardly extended from said bottom sole, said protruded units being resilient and having a columnar structure which defines a bottom end and a protruded unit cavity being provided at a center portion on said bottom end of said protruded unit, a peripheral side wall of said protruded unit cavity having a curved and inclined cross-sectional shape, wherein said protruded units has a trapezoidal cross sectional shape which defines a longer side and a shorter side opposing to said longer side, said protruded units being connected to said bottom sole through said corresponding shorter side of said protruded unit, wherein a surface area of a connecting junction between each said protruded unit and said bottom sole is smaller than a surface area of said bottom end of said protruded unit such that each said resilient and columnar structure of said protruded unit is deformed and compressed to having an increased surface area through outwardly extending from said peripheral portion of said protruded unit on said bottom end when said bottom sole is pressed against a ground surface, wherein said protruded units has three guiding grooves formed on said bottom end extending from the center of said protruded unit on said bottom end of said protruded unit to a peripheral portion of said protruded unit on said bottom end of said protruded unit and having an indentation construction for defining three guiding channels from said center to said peripheral portion of said protruded unit on said bottom end of said protruded unit, wherein each of said guiding grooves guides oil-base or water-base liquid to move from said center on said bottom end of said protruded unit towards said peripheral portion of said protruded unit through said guiding channels, thereby each said guiding groove is capable of guiding liquid movement while said protruded unit is capable of structurally supporting the bottom sole by its increased surface area through deformation to grip firmly onto the ground surface.

13. The slip-resistant sole, as recited in claim 12, wherein an angle of inclination between an outer side of said protruded units and said bottom sole is between approximately 75°.

14. The slip-resistant sole, as recited in claim 13, wherein said bottom end of said protruded units has a round-shape construction.

15. The slip-resistant sole, as recited in claim 14, wherein a junction groove is peripherally provided on all sides of each said protruded unit at the connecting junction between said protruded unit and said bottom sole for all said plurality of protruded units such that said plurality of protruded units are raised to having a greater height and isolated to having a greater flexibility.

* * * * *